US009841709B2

(12) United States Patent
Nakano

(10) Patent No.: US 9,841,709 B2
(45) Date of Patent: Dec. 12, 2017

(54) FIXING DEVICE AND IMAGE FORMING APPARATUS

(71) Applicant: KYOCERA Document Solutions Inc., Osaka-shi, Osaka (JP)

(72) Inventor: Kuniaki Nakano, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/458,836

(22) Filed: Mar. 14, 2017

(65) Prior Publication Data

US 2017/0299989 A1 Oct. 19, 2017

(30) Foreign Application Priority Data

Apr. 18, 2016 (JP) ..... 2016-082934

(51) Int. Cl.
*G03G 15/20* (2006.01)
*G03G 15/02* (2006.01)

(52) U.S. Cl.
CPC ..... *G03G 15/2017* (2013.01); *G03G 15/0216* (2013.01)

(58) Field of Classification Search
CPC ..... G03G 15/0216; G03G 15/0291; G03G 15/2017; G03G 15/2028
See application file for complete search history.

(56) References Cited

U.S. PATENT DOCUMENTS 6,952,548 B2 * 10/2005 Uchida ..... G03G 15/02 250/324
8,892,019 B2 * 11/2014 Hirayama ..... G03G 15/2021 399/122
2006/0062611 A1 * 3/2006 Ohishi ..... G03G 15/2028 399/328

FOREIGN PATENT DOCUMENTS

JP 2011048338 A 3/2011

* cited by examiner

*Primary Examiner* — Gregory H Curran
(74) *Attorney, Agent, or Firm* — Alleman Hall Creasman & Tuttle LLP

(57) ABSTRACT

A fixing device includes a first fixing member, a second fixing member, and a charge application portion. The first fixing member contacts unfixed toner on a sheet conveyed along a conveyance path. The second fixing member forms a nip portion between itself and the first fixing member such that the sheet passes through the nip portion. The charge application portion applies an electric charge to the unfixed toner on the sheet and to an outer circumferential surface of the first fixing member at a region on an upstream side of the nip portion in a movement direction of the outer circumferential surface, by causing a corona discharge to be generated between a discharge electrode and a counter electrode that are disposed apart from the outer circumferential surface of the first fixing member.

8 Claims, 6 Drawing Sheets

FIXING DEVICE AND IMAGE FORMING APPARATUS

INCORPORATION BY REFERENCE

This application is based upon and claims the benefit of priority from the corresponding Japanese Patent Application No. 2016-082934 filed on Apr. 18, 2016, the entire contents of which are incorporated herein by reference.

BACKGROUND

The present disclosure relates to a fixing device configured to fix toner to a sheet, and to an image forming apparatus.

In a fixing device, a sheet with a toner image formed thereon is passed through a nip portion between a pair of fixing members that are rollers or belts, and the sheet is heated and pressed while it passes through the nip portion. This allows the toner image to be fixed to the sheet.

In the above-mentioned fixing device, an offset phenomenon may occur, wherein in the offset phenomenon, a part of the toner transfers to the surface of the fixing member. There is known an image forming apparatus in which, to prevent the offset phenomenon, a corotron is provided between a transfer portion and the fixing portion such that the corotron applies an electric charge to the toner on the sheet.

SUMMARY

A fixing device according to an aspect of the present disclosure includes a first fixing member, a second fixing member, and a charge application portion. The first fixing member contacts unfixed toner on a sheet conveyed along a conveyance path. The second fixing member forms a nip portion between itself and the first fixing member such that the sheet passes through the nip portion. The charge application portion applies an electric charge to the unfixed toner on the sheet and to an outer circumferential surface of the first fixing member at a region on an upstream side of the nip portion in a movement direction of the outer circumferential surface, by causing a corona discharge to be generated between a discharge electrode and a counter electrode that are disposed apart from the outer circumferential surface of the first fixing member.

An image forming apparatus according to another aspect of the present disclosure includes an image generating portion and the fixing device. The image generating portion forms a toner image on a sheet. The fixing device fixes the toner image to the sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the present disclosure. It should be noted that the following embodiment is an example of a specific embodiment of the present disclosure and should not limit the technical scope of the present disclosure.

[Configuration of Image Forming Apparatus]

Figure 1:
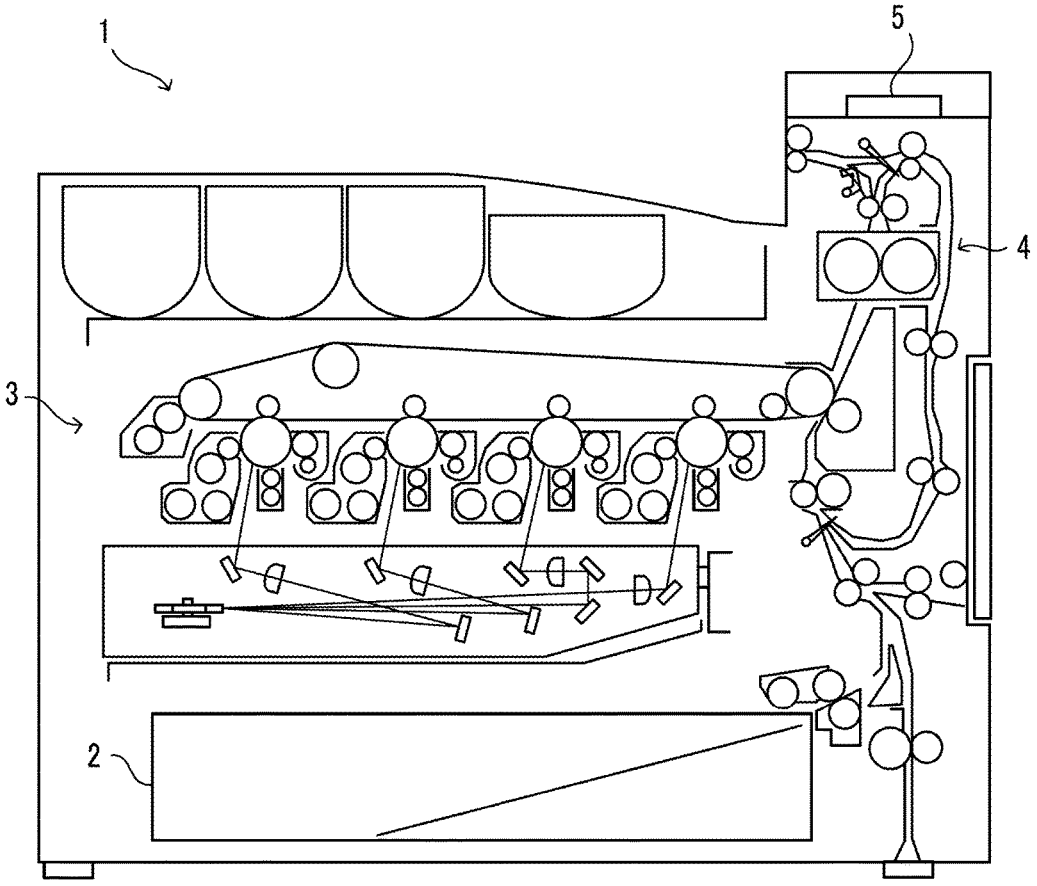
FIG. 1 is a diagram showing a configuration of an image forming apparatus according to an embodiment of the present disclosure.

First, a description is given of the configuration of an image forming apparatus 1 according to an embodiment of the present disclosure, with reference to FIG. 1. As shown in FIG. 1, the image forming apparatus 1 includes a sheet cassette 2, an image generating portion 3, a fixing portion 4, and a control portion 5. The fixing portion 4 or a combination of the fixing portion 4 and the control portion 5 is an example of the fixing device of the present disclosure. It is noted that the present disclosure is not limited to a printer, but is applicable to an arbitrary image forming apparatus such as a copier, a facsimile apparatus, or a multifunction peripheral.

The sheet cassette 2 stores sheets such as sheets of recording paper.

The image generating portion 3 includes a photoconductor drum, a charger, an exposure device, a developing device, and a transfer device. The image generating portion 3 forms a toner image on a sheet fed from the sheet cassette 2.

The fixing portion 4 fixes the toner image to the sheet by heating and pressing the sheet on which the toner image has been formed. A specific configuration of the fixing portion 4 is described below.

The control portion 5 includes control equipment such as CPU, ROM, and RAM. The CPU is a processor that executes various calculation processes. The ROM is a nonvolatile storage portion in which various information such as control programs for causing the CPU to execute various processes are stored in advance. The RAM is a volatile or nonvolatile storage portion that is used as a temporary storage memory (working area) for the various processes executed by the CPU. It is noted that the control portion 5 may include an electronic circuit that realizes the various processes.

[Configuration of Fixing Portion]

Figure 2:
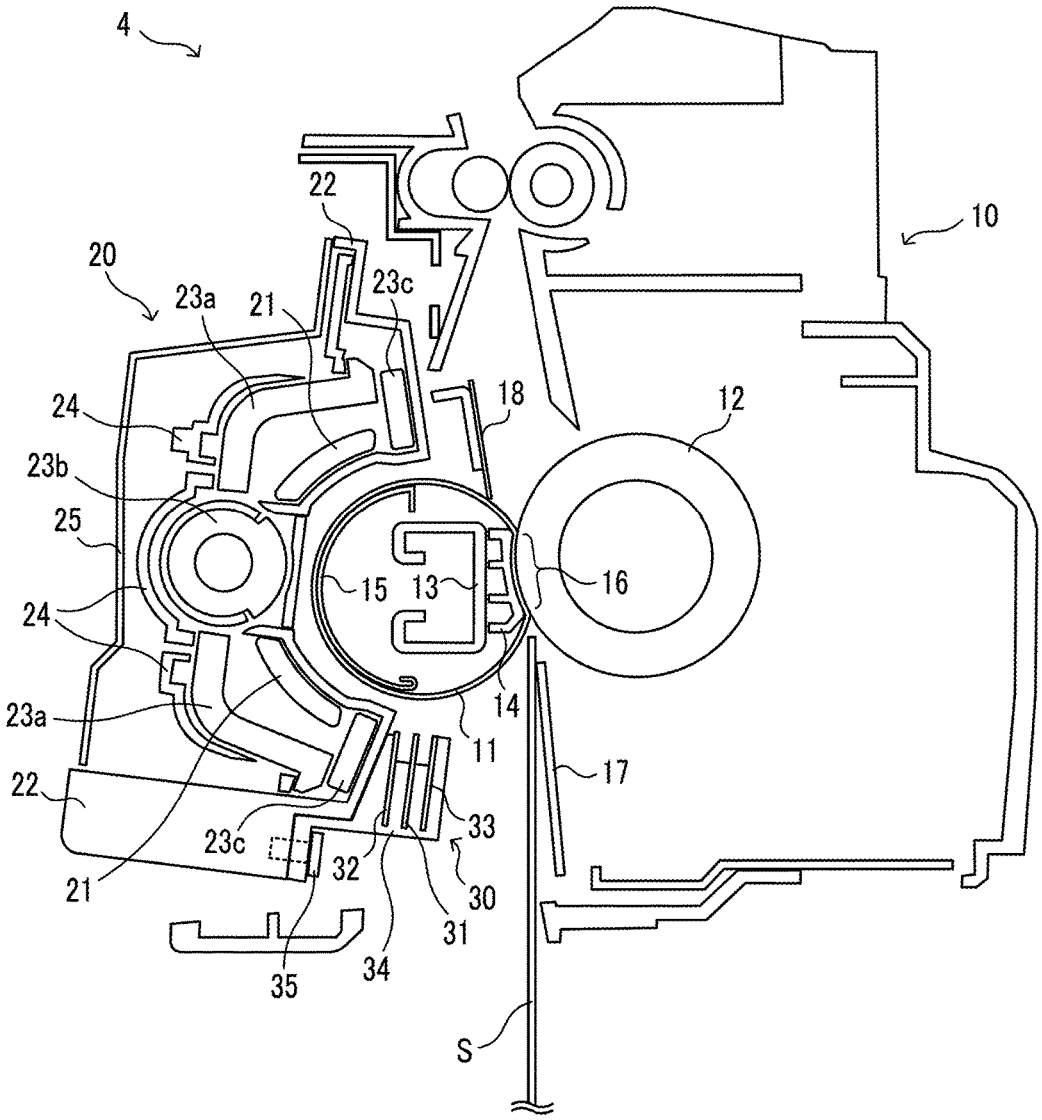
FIG. 2 is a diagram showing a configuration of a fixing portion of the image forming apparatus according to the embodiment of the present disclosure.

Next, a description is given of the configuration of the fixing portion 4 in the image forming apparatus 1 according to the embodiment of the present disclosure, with reference to FIG. 2.

The fixing portion 4 includes a fixing unit 10, an induction heating unit 20, and a charge application portion 30.

As shown in FIG. 2, the fixing unit 10 includes a fixing belt 11 (an example of the first fixing member of the present disclosure), a pressure roller 12 (an example of the second fixing member of the present disclosure), a holding member 13, a nip forming member 14, a guide plate 15, a conveyance guide 17, and a separation plate 18, wherein the holding member 13, the nip forming member 14, and the guide plate 15 are disposed inside the fixing belt 11.

The fixing belt 11 is formed in a substantially cylindrical shape that is elongated in a width direction perpendicular to the conveyance direction of a sheet S (hereinafter, the direction is merely referred to as a "width direction"). The fixing belt 11 is supported by the holding member 13, the nip forming member 14, and the guide plate 15 so as to be capable of rotating around a rotation axis that extends in the width direction.

The fixing belt 11 is composed of a base layer, an elastic layer and a release layer, wherein the elastic layer is formed on the base layer, and the release layer is formed to cover the elastic layer. The base layer is, for example, formed by the nickel electrocasting or by performing the plating treatment or the rolling treatment on a metal such as copper. The elastic layer is formed from silicon rubber, for example. The release layer is formed from fluororesin such as PFA, for example.

The pressure roller 12 is formed in a substantially cylindrical shape that is elongated in the width direction. The pressure roller 12 is pressed against the fixing belt 11 by a pressure mechanism (not shown), and a nip portion 16 is formed between the fixing belt 11 and the pressure roller 12. The pressure roller 12 is rotatably supported by a fixing frame (not shown). The pressure roller 12 is rotationally driven by a driving mechanism (not shown).

The pressure roller 12 is composed of, for example, a cylindrical core material, an elastic layer and a release layer, wherein the elastic layer is formed on the core material, and the release layer is formed to cover the elastic layer. The core material is formed, for example, by a metal such as stainless steel or aluminum. The elastic layer is formed from silicon rubber or silicon sponge, for example. The release layer is formed from fluororesin such as PFA, for example.

The induction heating unit 20 includes induction coils 21, coil holding portions 22, arch cores 23*a*, a center core 23*b*, side cores 23*c*, arch core holding portions 24, and a cover portion 25, wherein the induction coils 21 are disposed in an arc shape along an outer circumference of the fixing belt 11, the coil holding portions 22 hold the induction coils 21, and the arch core holding portions 24 hold the arch cores 23*a*.

When toner T is fixed to the sheet S, a high-frequency current is applied to the induction coils 21. This causes the induction coils 21 to generate a magnetic field. An eddy current is then generated in the fixing belt 11 by the act of the magnetic field, and the fixing belt 11 is heated. That is, the fixing belt 11 is heated by the induction coils 21. In addition, the guide plate 15 is heated by the act of the magnetic field, and the fixing belt 11 is heated also by the guide plate 15.

In addition, when the toner T is fixed to the sheet S, the pressure roller 12 is rotationally driven by a driving mechanism (not shown). This causes the fixing belt 11 that is pressed against the pressure roller 12, to be rotated following the rotation of the pressure roller 12. The fixing belt 11 rotated in this way slides over the nip forming member 14. In this situation, when the sheet S enters the nip portion 16, the heated fixing belt 11 contacts the unfixed toner T on the sheet S. This causes the toner T to be fused, pressed, and fixed to the sheet S. After it passes through the nip portion 16, the sheet S is separated from the fixing belt 11 by the separation plate 18, and is discharged to outside the fixing unit 10.

Meanwhile, in the fixing portion 4 having the above-described configuration, an offset phenomenon may occur, wherein in the offset phenomenon, a part of the toner T transfers to the surface of the fixing belt 11. It is considered that, to prevent the offset phenomenon, a corotron may be provided between the fixing portion 4 and the transfer device of the image generating portion 3 such that the corotron applies an electric charge to the toner T on the sheet S. However, the ease of occurrence of the offset phenomenon depends not only on the charged state of the toner T on the sheet, but also on the charged state of the fixing belt 11. Accordingly, only the application of an electric charge to the toner T on the sheet S cannot restrict the offset phenomenon sufficiently. As a result, in the present embodiment, the charge application portion 30 is provided so that the offset phenomenon can be restricted sufficiently.

In the present embodiment, it is supposed that unfixed toner T on the sheet S has been positively charged. On the other hand, fluororesin such as PFA that is used in the release layer of the fixing belt 11, is likely to be negatively charged. Thus in this state, the offset phenomenon is likely to occur, wherein in the offset phenomenon, the positively charged toner T transfers to the negatively charged surface of the fixing belt 11. In view of this, in the present embodiment, the charge application portion 30 applies an electric charge of the same polarity as that of the toner T on the sheet S (namely, the positive polarity), to the surface of the fixing belt 11. With such a configuration of the present embodiment where the surface of the fixing belt 11 is charged to the same polarity as that of the toner T, the repulsion of the charges is utilized, and the transfer of the toner T to the surface of the fixing belt 11 is effectively restricted.

[Configuration of Charge Application Portion]

The charge application portion 30 includes a discharge electrode 31, a pair of counter electrodes 32 and 33, an electrode holding portion 34, and a bolt 35. The counter electrodes 32 and 33 face each other across the discharge electrode 31. The electrode holding portion 34 holds these electrodes. The bolt 35 fixes the electrode holding portion 34 to the coil holding portions 22 of the induction heating unit 20 in a detachable manner.

Figure 3:
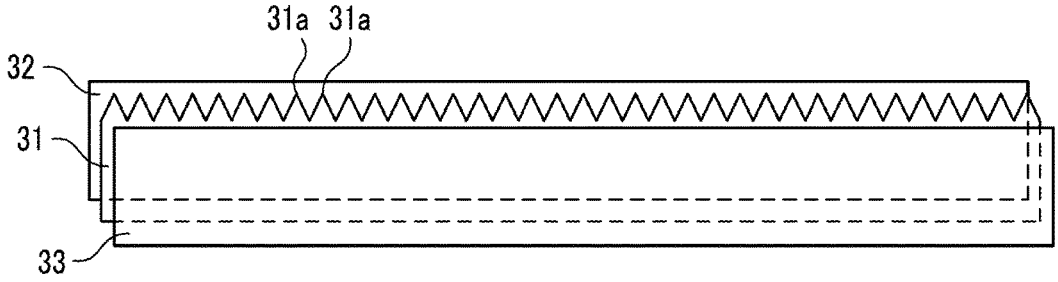
FIG. 3 is a diagram showing shapes of a discharge electrode and counter electrodes of the image forming apparatus according to the embodiment of the present disclosure.

The discharge electrode 31 and the counter electrodes 32 and 33 are disposed apart from the outer circumferential surface of the fixing belt 11. As shown in FIG. 3, the discharge electrode 31 is a plate-like electrode made of stainless steel that is thin in plate thickness (approximately 0.1 mm), wherein saw teeth are formed along the width direction at an edge portion facing the fixing belt 11. The counter electrodes 32 and 33 are plate-like electrodes made of stainless steel, and are disposed apart by a predetermined distance from pointed end portions 31*a* of teeth formed on the discharge electrode 31.

Figure 4:
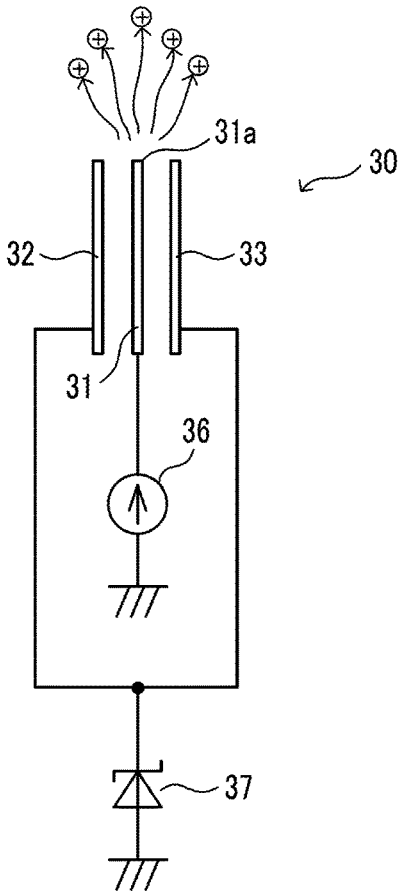
FIG. 4 is a diagram showing a configuration of a charge application portion of the image forming apparatus according to the embodiment of the present disclosure.
Figure 5:
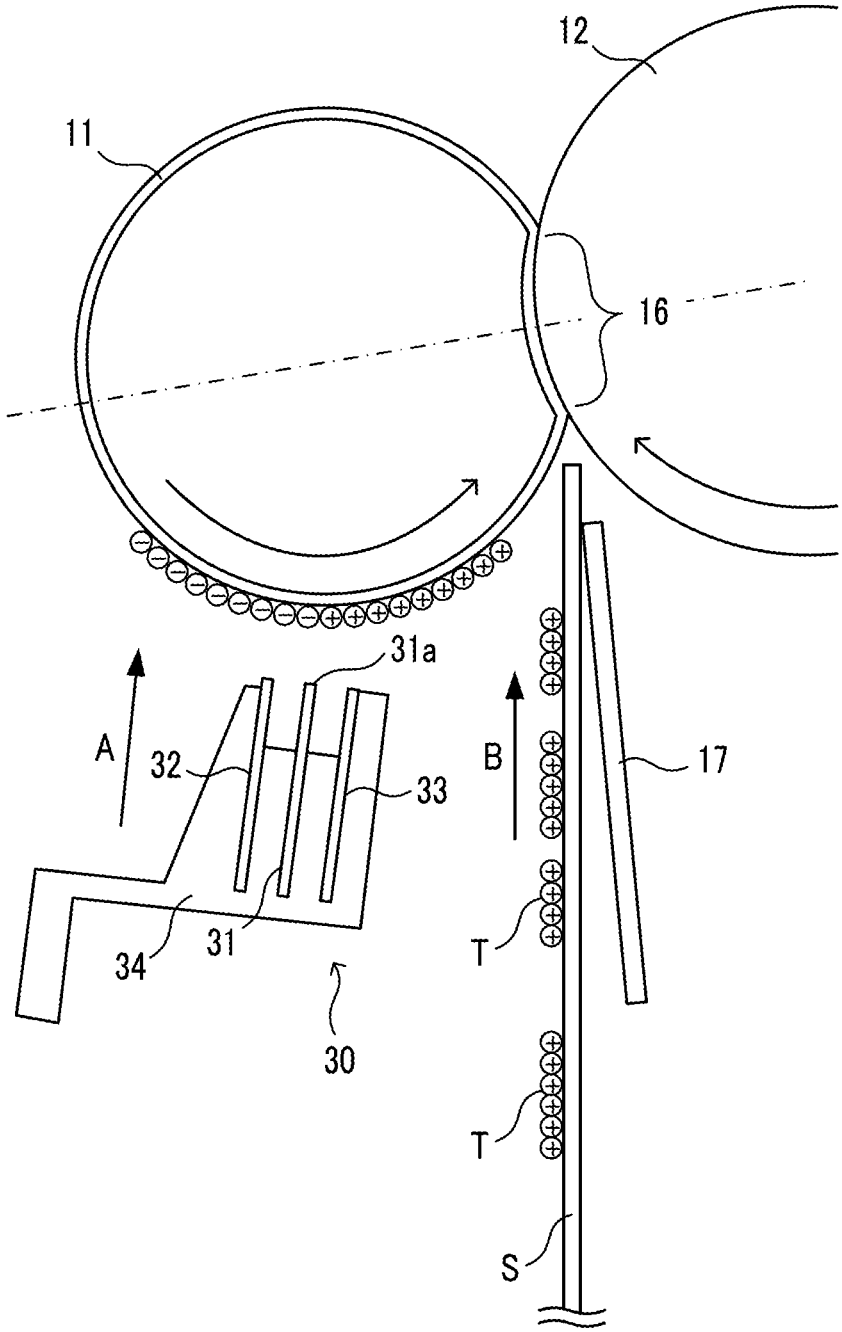
FIG. 5 is a diagram showing an example of a fixing belt and a toner image that are in a charged state in the image forming apparatus according to the embodiment of the present disclosure.

FIG. 4 shows a configuration of the charge application portion 30. A high-voltage power source 36 is connected to the discharge electrode 31. When the fixing portion 4 performs a fixing operation, the control portion 5 performs a control to apply a high voltage to the discharge electrode 31. When a high voltage is applied to the discharge electrode 31, a corona discharge is continuously generated between the pointed end portions 31*a* of the teeth formed on the discharge electrode 31 and the counter electrodes 32 and 33. Positive ions generated by the corona discharge move in a direction of going away from the pointed end portions 31*a* of the discharge electrode 31, and the surface of the fixing belt 11 is positively charged by part of the positive ions. As a result, as shown in FIG. 5, the surface of the fixing belt 11 that had been negatively charged is positively charged by the positive ions coming from the charge application portion 30, and while keeping that state, the surface of the fixing belt 11 moves toward the nip portion 16. This allows the toner T on the sheet S and the surface of the fixing belt 11 to have the same polarity in the nip portion 16, which makes it possible to restrict the transfer of the toner T to the surface of the fixing belt 11.

It is noted that another part of the positive ions generated by the corona discharge passes through a gap between the fixing belt 11 and the counter electrode 33 and reaches the surface of the sheet S that is moving toward the nip portion 16. As a result, the toner T on the surface of the sheet S is further positively charged by the positive ions coming from the charge application portion 30, and while keeping that state, the sheet S moves toward the nip portion 16. This makes it possible to further restrict the transfer of the toner T to the surface of the fixing belt 11. Here, the charge application portion 30 is disposed to face a region on the outer circumferential surface of the fixing belt 11 that is on the upstream side of the nip portion 16 in the movement direction of the outer circumferential surface (namely, a region lower than the one-dot chain line shown in FIG. 5) so that the positive ions generated by the corona discharge can more easily reach the toner T on the sheet S that is moving toward the nip portion 16. It is noted that the direction in which the pointed end portions 31*a* of the discharge electrode 31 extend (the direction indicated by the arrow A in FIG. 5) may be slightly inclined toward a conveyance path preceding the nip portion 16, with respect to a direction parallel to the conveyance path (the direction indicated by the arrow B in FIG. 5) so that the positive ions generated by the corona discharge can more easily reach the toner T on the sheet S. It is noted that in the present embodiment, since the main role of the charge application portion 30 is to positively charge the surface of the fixing belt 11 that has been negatively charged, the distance between the pointed end portions 31*a* and the fixing belt 11 is shorter than the distance between the pointed end portions 31*a* and the conveyance path.

Figure 6:
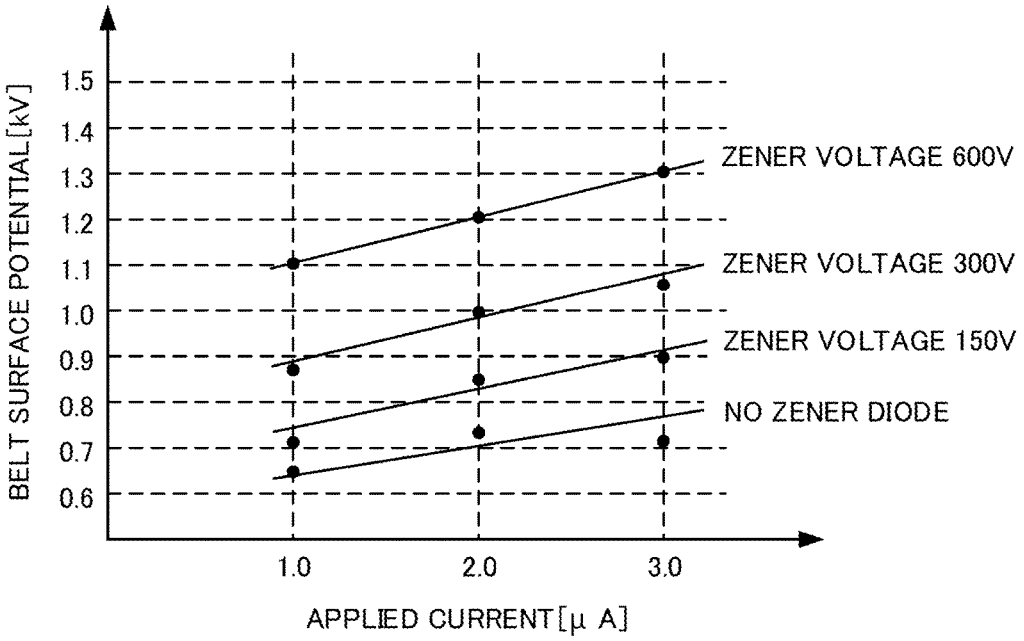
FIG. 6 is a diagram showing an example of relationship among a current applied to the discharge electrode, a surface potential of the fixing belt, and Zener voltages, in the image forming apparatus according to the embodiment of the present disclosure.

It is noted that in the present embodiment, as shown in FIG. 4, the counter electrodes 32 and 33 are grounded via a Zener diode 37 to enhance the effect of positively charging the surface of the fixing belt 11. FIG. 6 is a graph plotting measurement results of the surface potential of the fixing belt 11 against a current applied to the discharge electrode 31 for different Zener voltages of the Zener diode 37. As apparent from FIG. 6, the larger the current applied to the discharge electrode 31 is, the higher the surface potential of the fixing belt 11 is. Also, the higher the Zener voltage of the Zener diode 37 is, the higher the surface potential of the fixing belt 11 is. This is because, as the Zener voltage of the Zener diode 37 is raised, the potential of the counter electrodes 32 and 33 is raised, and as a result, in the positive ions generated by the corona discharge, the ratio of the positive ions moving toward the counter electrodes 32 and 33 decreases, and the ratio of the positive ions moving toward the fixing belt 11 increases. As a result, as the Zener voltage is made higher, the effect of positively charging the surface of the fixing belt 11 is enhanced. However, if the Zener voltage is excessively increased, the surface of the conveyance guide 17 may be positively charged during an interval in which no sheet S passes before the conveyance guide 17, and the positively charged conveyance guide 17 may attract a negatively charged sheet S. In view of this, the Zener diode 37 with 150 V Zener voltage is used in the present embodiment.

It is noted that as another method to enhance the effect of positively charging the surface of the fixing belt 11, the distance between the pointed end portions 31*a* of the discharge electrode 31 and the counter electrodes 32 and 33 may be increased. However, to increase the distance between the pointed end portions 31*a* of the discharge electrode 31 and the counter electrodes 32 and 33, a wider installation space is required. On the other hand, the Zener diode 37 adopted in the present embodiment enhances the effect of positively charging the surface of the fixing belt 11 without requiring a wider installation space.

As described above, according to the present embodiment, with the configuration where the charge application portion 30 applies an electric charge to the surface of the fixing belt 11 and to the toner T on the sheet S, it is possible to restrict the offset phenomenon sufficiently.

It is noted that according to the present embodiment, it is supposed that the toner T on the sheet S has been positively charged. However, in a case where the toner T on the sheet S has been negatively charged, a negative voltage may be applied to the discharge electrode 31 of the charge application portion 30 so that the surface of the fixing belt 11 can be negatively charged. In this case, too, as in the present embodiment, the surface of the fixing belt 11 is charged to the same polarity as that of the toner T, and the transfer of the toner T to the surface of the fixing belt 11 can be effectively restricted, utilizing the repulsion of the charges.

In addition, in the present embodiment, a plate-like electrode made of stainless steel on which saw teeth are formed is used as the discharge electrode 31 of the charge application portion 30. However, the discharge electrode of the present disclosure is not limited to this, but may be an electrode of an arbitrary shape including a plurality of pointed end portions 31*a* that are arranged side-by-side along the width direction perpendicular to the sheet S conveyance direction. Furthermore, a tungsten wire may be used as the discharge electrode 31. However, using a tungsten wire as the discharge electrode 31 has a defect that a large amount of ozone is generated. As a result, to restrict the amount of ozone to be generated, it is preferable to use an electrode that includes a plurality of pointed end portions 31*a* such as saw teeth.

Figure 7:
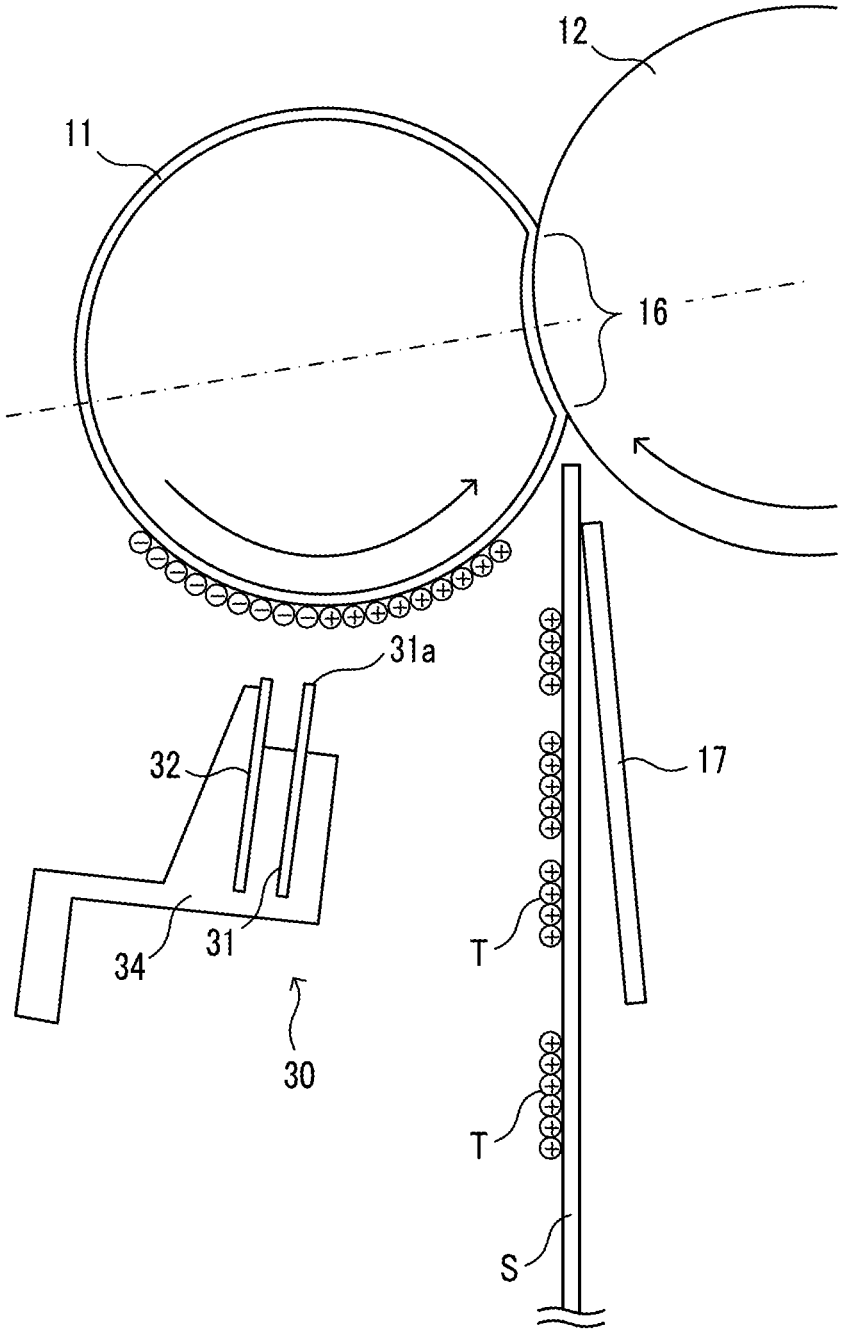
FIG. 7 is a diagram showing a configuration of a variation of the charge application portion in the image forming apparatus according to the embodiment of the present disclosure.

In addition, in the present embodiment, the pair of counter electrodes 32 and 33 that face each other across the discharge electrode 31 are provided. However, to further enhance the effect of positively charging the toner T on the sheet S, only the counter electrode 32 that is farther away from the conveyance path preceding the nip portion 16 than the discharge electrode 31 may be provided, as shown in FIG. 7. With this configuration, it becomes easy for the positive ions generated by the corona discharge to move toward the toner T on the sheet S. However, if a priority is given to stable generation of corona discharge, the pair of counter electrodes 32 and 33 that face each other across the discharge electrode 31 may be provided, as in the present embodiment.

In addition, in the present embodiment, the induction heating unit 20 is used to heat the fixing belt 11. However, the present disclosure is not limited to this, but is applicable to, for example, a configuration where the fixing roller is heated by a halogen heater.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a first fixing member configured to contact unfixed toner on a sheet conveyed along a conveyance path;

a second fixing member configured to form a nip portion between itself and the first fixing member such that the sheet passes through the nip portion; and a charge application portion configured to apply an electric charge to the unfixed toner on the sheet and to an outer circumferential surface of the first fixing member at a region on an upstream side of the nip portion in a movement direction of the outer circumferential surface, by causing a corona discharge to be generated between a discharge electrode and a counter electrode that are disposed apart from the outer circumferential surface of the first fixing member.

2. The fixing device according to claim 1, wherein the discharge electrode includes a plurality of pointed end portions that are arranged side-by-side along a width direction perpendicular to a conveyance direction of the sheet.

3. The fixing device according to claim 2, wherein the discharge electrode is a plate-like electrode on which saw teeth are formed along the width direction, and the plurality of pointed end portions are tip portions of the saw teeth.

4. The fixing device according to claim 1, wherein the counter electrode is grounded via a Zener diode.

5. The fixing device according to claim 1, wherein the counter electrode includes a pair of electrodes that face each other across the discharge electrode.

6. The fixing device according to claim 1, wherein the counter electrode is disposed at a position that is farther away from the conveyance path preceding the nip portion than the discharge electrode.

7. The fixing device according to claim 2, wherein a direction in which the pointed end portions extend is inclined toward the conveyance path preceding the nip portion, with respect to a direction parallel to the conveyance path.

8. An image forming apparatus comprising:

an image generating portion configured to form a toner image on a sheet; and the fixing device according to claim 1 configured to fix the toner image to the sheet.

* * * * *